US005333569A

United States Patent [19]

Henderson

[11] Patent Number: 5,333,569

[45] Date of Patent: Aug. 2, 1994

[54] INFLATABLE SAIL BATTENS

[76] Inventor: Robert J. Henderson, 56 Hillsmount Road, London, Ontario, Canada, N6K 1W2

[21] Appl. No.: 997,309

[22] Filed: Dec. 23, 1992

[51] Int. Cl.[5] ..... B63H 9/04

[52] U.S. Cl. ..... 114/103

[58] Field of Search ..... 114/39.1, 39.2, 102, 114/103, 104, 105, 106, 107, 345

[56] References Cited

U.S. PATENT DOCUMENTS

| | | | |
|---|---|---|---|
| 2,743,510 | 5/1956 | Mauney et al. | 114/345 |
| 3,391,668 | 7/1968 | Birchill | 114/103 |
| 3,444,834 | 5/1969 | Bever et al. | 114/102 |
| 3,763,703 | 10/1973 | Man | 114/102 |
| 4,633,798 | 1/1987 | Skinner et al. | 114/107 |
| 4,708,078 | 11/1987 | Legaignoux et al. | 114/102 |
| 5,095,837 | 3/1992 | Baird | 114/103 |

*Primary Examiner*—Stephen P. Avila
*Attorney, Agent, or Firm*—Barrigar & Moss

[57] ABSTRACT

An inflatable sail batten and a sail incorporating same is disclosed. The batten is located in a conventional sail batten pocket. The batten is formed of a hollow, elongate, impervious, flexible tube having sealed opposed ends. An inlet tube communicates with the interior of the flexible tube. A supply tube runs up inside the leech of the sail and is connected to the inlet tube. The supply tube is connected to a valve for inflating the batten. The sail can have any number of such battens and the battens can be any length desired.

5 Claims, 2 Drawing Sheets

INFLATABLE SAIL BATTENS

FIELD OF THE INVENTION

This invention relates to sailboat sail battens, and in particular, to battens intended for use with sails that furl along the luff thereof.

Most sails built for sailing vessels, sailboards or any other type of wind powered apparatus employ battens to maintain sail shape, unless the sails are designed for light air use or the sails are cut or designed in such a way that natural pulling forces on the clew of the sail maintain the desired shape. This latter approach is satisfactory for larger headsails, but for mainsails and smaller headsails designed for higher wind ranges, battens are a must in order to maximize sail area and provide stability and efficient drive from the sails. This invention relates to the type of sails that do require battens, and is particularly useful for sails that are intended to be furled parallel to the luff, which up to now have not been able to have battens, at least battens that can be left in the sails while the sails are being furled.

Battens that have been used in the past for sails have been made out of strips of wood, glass reinforced plastics, or even metal flat stock. The battens are usually required to be able to bend laterally a little bit in order to conform to the desired sail shape, but by and large, the battens are relatively rigid. Accordingly, to shorten or lower the sails, the sail area has to be reduced in a direction parallel to the battens.

While the prior art battens have performed relatively well, it is a shortcoming in that they cannot be used on sails that are intended to be furled along the luff, unless the battens are removed before the sail is furled. This is a major inconvenience, with the result that most furling sails are designed without battens. This usually means that such sails have very little, if any, roach. In the case of mainsails, this means that such mainsails do not perform nearly as well as sails with battens. The result is that usually one has to make a trade-off between the convenience of furling on the one hand, and the increased sail performance or efficiency of battens on the other hand.

One attempt to produce battens that could be used with furling sails employed face-to-face elongate concave strips of thin resilient material, the strips being something like the slats in a venetian blind or a roll-up steel measuring tape. This type of batten can be flattened and rolled up, but it cannot bend laterally without kinking and it has very little lateral strength, so it is generally not satisfactory.

SUMMARY OF THE INVENTION

The present invention provides a batten having an inflatable, elongate, impervious tube, which provides all of the lateral strength desired when pressurized, but which can simply be deflated and rolled up as the sail is furled.

According to one aspect of the invention, there is provided an inflatable sail batten comprising a hollow, elongate, impervious, flexible tube having opposed end portions. Means are provided for sealing each end portion of the tube, and an inlet tube is mounted in one end portion communicating with the interior of the flexible tube for inflating the flexible tube.

According to another aspect of the invention there is provided a sail comprising an elongate batten pocket having an opening adjacent to the leech of the sail. An inflatable batten is slidably located in the pocket, the batten being formed of an elongate, hollow, impervious, flexible tube sealed at both ends. An inlet tube communicates with the interior of the flexible tube, the inlet tube having an inlet end located adjacent to the pocket opening. Means is provided for retaining the batten in the pocket, and a valve is operatively connected to the inlet tube.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
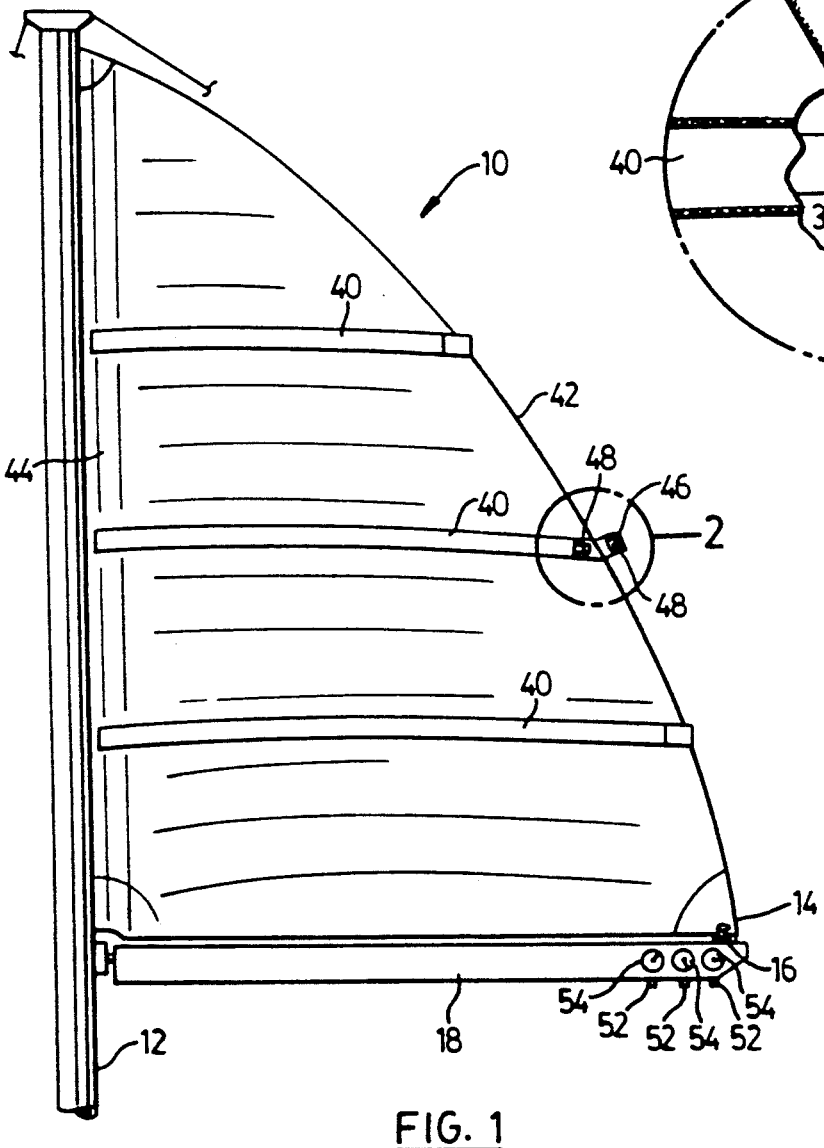
FIG. 1 is an elevational view of a sailboat mainsail.

Referring firstly to FIG. 1, a typical sailboat furling mainsail is generally represented by reference numeral 10. Mainsail 10 is of the type that furls about the luff, the furling gear being mounted inside mast 12. The clew 14 of mainsail 10 is attached to a slider or car 16 slidably mounted in boom 18 and attached to a conventional outhaul (not shown) located inside boom 18.

The mast 12, boom 18 and the furling gear and attachment of mainsail 10 are conventional and are not considered to be part of the present invention.

Referring in particular to FIGS. 3 to 6, a batten 20 is shown having a hollow, elongate, impervious, flexible tube 22 and first and second end portions 24, 26. Tube 22 is typically formed of a woven core layer 28 and an impervious layer or coating 30. Actually, core layer 28 could be coated on both sides or impregnated with an impervious material. For example, core layer 28 could be a nylon or polyester woven tube and impervious layer 30 could be a polyurethane coating. Alternatively, flexible tube 22 could be made with a polyurethane or rubber inner tube adhesively attached to a woven outer sleeve. Tube 22 can be made from any suitable material. However, it should be able to withstand internal pressures of up to about seven hundred kilopascals (100 psi), and it should be very low stretch material. One particularly useful type of tubing for batten 20 is that which is used for fire hoses. This is considered to be impervious, flexible, non-stretch material for the purposes of the present invention. It is also flat in its natural state, which aids in the installation of battens 20 as described further below.

The inside diameter of flexible tube 22 when it is inflated is typically between 2 and 4 centimetres (¾" to 1½"). The wall thickness of tube 22 is typically between 3 and 5 millimetres (approximately one-eighth of an inch), so that flexible tube 22 is about 6 millimetres (¼") in thickness when it is flat.

Figure 3:
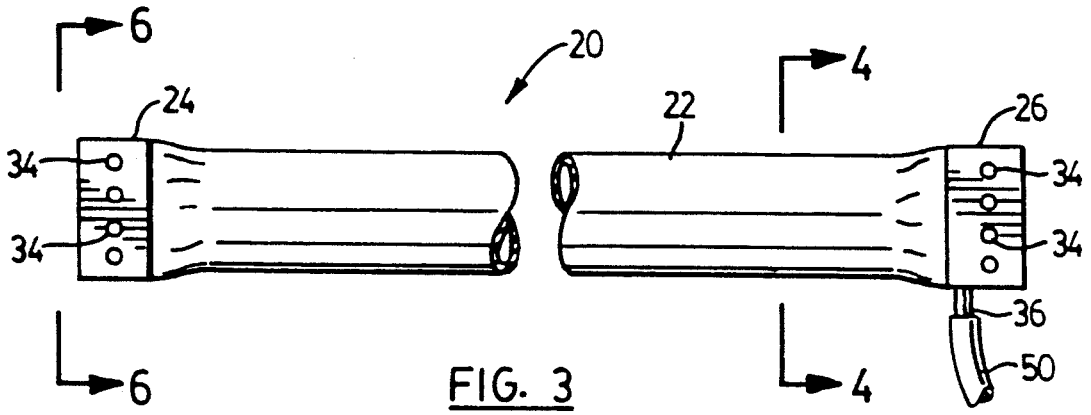
FIG. 3 is an elevational view of a preferred embodiment of a sail batten made in accordance with the present invention.
Figure 4:
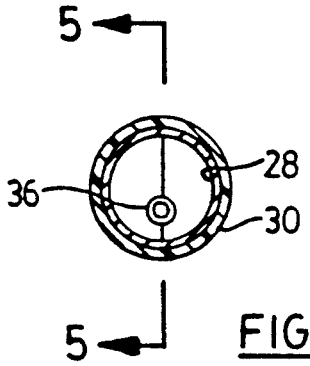
FIG. 4 is a sectional view taken along lines 4—4 of FIG. 3.
Figure 6:
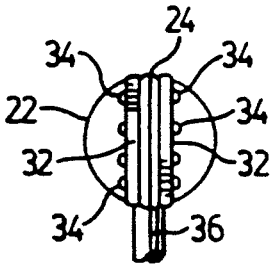
FIG. 6 is an end view of the batten shown in FIG. 3 taken along lines 6—6 of FIG. 3.

Referring in particular to FIGS. 3 and 6, end portions 24, 26 are sealed by squeezing the ends of tube 22 between a pair of metal plates 32 and riveting these plates together with rivets 34. Aluminum plates 32 and aluminum rivets 34 are preferred, but these components could be made from stainless steel, if desired. Before assembling end portions 24, 26 a suitable adhesive or solvent would be applied to the interior surfaces of tube 22 to ensure that a good pressure-tight bond is made to seal end portions 24, 26. If a good solvent or adhesive bond could be made in end portions 24, 26 without end plates 32, then end plates 32 and rivets 34 could be eliminated.

Figure 5:
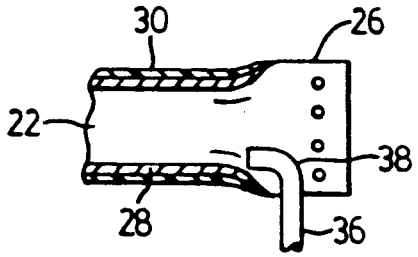
FIG. 5 is a sectional view taken along lines 5—5 of FIG. 4.

Referring next to FIG. 5, an inlet tube 36 is shown mounted in end portion 26 to communicate with the interior of flexible tube 22 for inflating the tube. Grooves 38 can be formed in plates 32 to ensure that there is a good seal around inlet tube 36. However, inlet tube 36 could be mounted directly in the wall of tube 22 with a suitable fitting, if desired.

Figure 2:
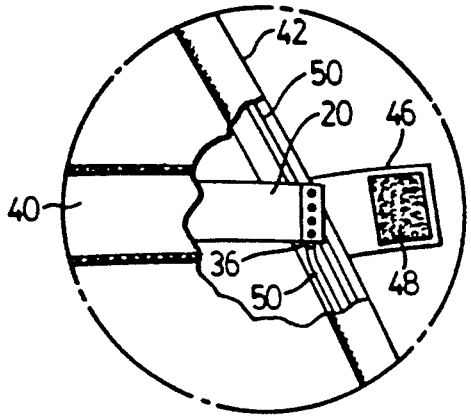
FIG. 2 is an enlarged detail view of the portion of FIG. 1 indicated by circle 2.

Referring again to FIGS. 1 and 2, sail 10 is shown having full length batten pockets 40, however, the batten pockets could be shorter and extend from leech 42 only part way toward luff 44 if desired. Three batten pockets 40 are shown in sail 10, but the number depends upon the size of the sail and it could be as few as one and as many as five or six in a typical pleasure craft sail. Batten pockets 40 are made by sewing a strip or panel of sail cloth onto the side of sail 10 and they can be put on either side of the sail, sometimes alternating from one side to the other. Batten pockets 40 typically are sewn or clamped closed at the inner end adjacent to luff 44 and are open at the outer end adjacent to leech 42, so that battens 20 can be inserted into pockets 40. A flap 46 typically extends from behind the sail, wraps around leech 42 and covers the open end of the batten pocket 40. Flap 46 is typically held closed by hook and loop type fastening material 48 attached respectively to the inside of flap 46 and to the outside of batten pocket 40. Flap 46 thus is the means for retaining batten 20 in batten pocket 40.

The inlet tubes 36 of each batten are connected to a respective supply tube 50 located in leech 42 of sail 10. The supply tubes 50 run down the leech from each batten, exit through or adjacent to clew 14 and pass into boom 18 to be coupled to respective valves 52. Valves 52 preferably are of the Schroeder type, such as are used for inflating bicycle and automotive tires. Pressure gauges 54 are coupled to communicate with each supply tube 50 to indicate the pressure to which each batten 20 is inflated.

To assemble battens 20 in mainsail 10, flaps 46 are opened and battens 20 are slid into each batten pocket 40. Supply tubes 50 are run up inside leech 42 or are installed in leech 42 when the sail is made. Supply tubes 50 are then connected to respective inlet tubes 36. A suitable clamp can be used to retain the supply tubes 50 on the inlet tubes 36, if desired. The lower ends of supply tubes 50 are then connected to the respective valves 52, or to gauges 54 and then onto valves 52 using a suitable tee if necessary.

In operation, after the battens have been installed in sail 10, an air pump is attached to the respective valves 52, and the battens are pumped up to the desired pressure. Alternatively, a supply of pressurized gas, such as helium, could be used to inflate battens 20. A further alternative would be to inflate the battens with another fluid, such as water. In any event, the battens are pressurized to give the stiffness or lateral strength desired. Each batten can be inflated to a different pressure to suit the sail shape. The pressure can also be adjusted to suit the strength of the wind on the sails simply by opening valves 52 or pumping more air or other fluid into the battens through valves 52.

When it is desired to furl sail 10 inside mast 12, valves 52 are opened to deflate the battens. The sail can then be furled rolling the battens up inside the sail expelling any residual air inside the battens.

If it is desired to sail with the sail partially furled, the battens are first deflated, the sail is furled to the extent desired, and then the battens are re-inflated or pressurized, so that the unfurled portions of the battens again become rigid and perform their desired stiffening affect.

Having described preferred embodiments of the invention, it will be appreciated that various other modifications may be made to the structures described. For example, battens 20 could be tapered having a relatively small inner or first end portion 24 and a larger or outer opposed end portion 26. Gauges 54 could be eliminated, especially if the pumping means or pressurized source for inflating battens 20 has its own gauge. Valves 52 do not need to be mounted in boom 18. They could simply be connected to the ends of supply tubes 50 emerging from the leech of the sail near clew 14. This, of course, would be the construction if battens 20 are used on a head sail, for example, or any other sail not having an associated boom along the foot of the sail. If the batten pockets 40 are all within reach, or if it is not desired to be able to furl the sail, then valves 52 could just be connected to inlet tubes 36 eliminating supply tubes 50. In the latter case, the battens would be inflated before the sail is hoisted and the sail could be lowered to adjust the pressure in the battens.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What is claimed is:

1. A sail comprising:

a sail having a luff, a foot and a leech extending therebetween;

an elongate batten pocket having an opening adjacent to the leech of the sail;

an inflatable batten slidably located in said pocket, said batten being formed of an elongate, hollow, fluid-impervious, flexible tube sealed at both ends and having an inlet tube communicating with the interior of the flexible tube, the inlet tube having an inlet end located adjacent to said pocket opening;

means for retaining the batten in said pocket;

a valve operatively connected to the inlet tube; and a supply tube located in the leech of the sail and coupled between the inlet tube and the valve.

2. A sail as claimed in claim 1 and further comprising a pressure gauge coupled to communicate with the supply tube.

3. A sail comprising:

a sail having a luff, a foot and a leech extending therebetween;

a plurality of elongate batten pockets having openings adjacent to the leech of the sail;

an inflatable batten slidably located in each pocket, each said batten being formed of an elongate, hollow, fluid-impervious, flexible tube sealed at both ends and having an inlet tube communicating with the interior of the flexible tube, the inlet tube having an inlet end located adjacent to its associated pocket opening;

means for retaining the battens in said pockets;

a valve operatively connected to the inlet tubes; and a plurality of supply tubes mounted in the leech of the sail, one supply tube being coupled between the valve and each inlet tube.

4. A sail as claimed in claim 3 wherein the valve is a first valve and further comprising a plurality of valves, each supply tube being coupled to a separate valve.

5. A sail as claimed in claim 4 and further comprising pressure gauges coupled to communicate with each supply tube.

* * * * *